United States Patent [19]

Stedman

[11] 4,049,139

[45] Sept. 20, 1977

[54] BACKHOE WITH MULTI-MOVEMENT CAPABILITIES

[75] Inventor: Robert N. Stedman, Chillicothe, Ill.

[73] Assignee: Caterpillar Tractor Co., Peoria, Ill.

[21] Appl. No.: 661,088

[22] Filed: Feb. 25, 1976

[51] Int. Cl.[2] ..... E02F 3/75

[52] U.S. Cl. ..... 214/138 R; 214/138 C

[58] Field of Search ..... 214/132, 138 R, 138 C, 214/138 D, 138 E, 138 F, 138 G

[56] References Cited

U.S. PATENT DOCUMENTS

| | | | |
|---|---|---|---|
| 2,927,706 | 3/1960 | Mork | 214/138 R |
| 3,027,026 | 3/1962 | Couquet | 214/138 R |
| 3,099,358 | 7/1963 | Clark | 214/138 C X |
| 3,250,410 | 5/1966 | Dorkins | 214/138 C |
| 3,313,431 | 4/1967 | Kelly | 214/138 C |
| 3,445,016 | 5/1969 | Tomlinson | 214/138 R |

FOREIGN PATENT DOCUMENTS

| | | | |
|---|---|---|---|
| 684,904 | 1/1967 | Belgium | 214/138 C |
| 1,383,638 | 2/1975 | United Kingdom | 214/138 C |

*Primary Examiner*—L. J. Paperner
*Attorney, Agent, or Firm*—Phillips, Moore, Weissenberger, Lempio & Majestic

[57] ABSTRACT

A backhoe comprises a support member pivotally mounted thereon for horizontal swinging movements relative thereto by actuating means operatively interconnected between the support member and frame. A boom is pivotally mounted on the support member for horizontal pivotal movements relative thereto by a first hydraulic swing motor and a dipper stick assembly is pivotally mounted on said boom for vertical pivotal movements relative thereto by a hydraulic cylinder pivotally interconnected therebetween. The dipper stick assembly comprises a support bracket having a dipper stick rotatably mounted therein and a dipper bucket mounted on a lower end of the dipper stick. A second hydraulic swing motor is operatively interconnected between the dipper stick and the bracket for selectively rotating the dipper stick thereon.

26 Claims, 17 Drawing Figures

BACKHOE WITH MULTI-MOVEMENT CAPABILITIES

BACKGROUND OF THE INVENTION

A standard backhoe normally comprises a dipper stick pivotally mounted for vertical movements on a boom, rotatably mounted for horizontal swinging movements on a rearward end of the backhoe. A bucket is pivotally mounted on a lower end of the dipper stick to provide a work tool for performing a number of operations which are difficult to perform with other types of earthworking machines, The backhoe is particularly useful for work in close quarters wherein the bucket may be moved alongside the backhoe for trenching purposes, for example.

SUMMARY OF THIS INVENTION

An object of this invention is to provide an improved backhoe which exhibits increased work capabilities over conventional ones. The backhoe comprises a support member pivotally mounted on a frame for horizontal pivotal movement relative thereto by a first actuating means. A boom is pivotally mounted on the support member and adapted to be rotated thereon by second actuating means, preferably in the form of a hydraulic swing motor. A dipper stick assembly, having a work tool such as a bucket pivotally mounted on a lower end thereof, is pivotally mounted on an upper end of the boom and adapted to be moved thereon by a third actuating means.

The dipper stick assembly comprises a support bracket pivotally mounted on the boom and a dipper stick rotatably mounted on the support bracket and adapted to be rotated thereon by fourth actuating means, preferably a second hydraulic swing motor, operatively interconnected between the dipper stick and support bracket. Such a backhoe construction and arrangement provides for selective multi-movements of the bucket for performing a wide variety of work tasks. The boom is adapted for detachment from the support member to be replaced by another work tool (trencher, grader, etc.) and support therefor.

BRIEF DESCRIPTION OF THE DRAWINGS

Other objects of this invention will become apparent from the following description and accompanying drawings wherein.

Figures 2, 6:
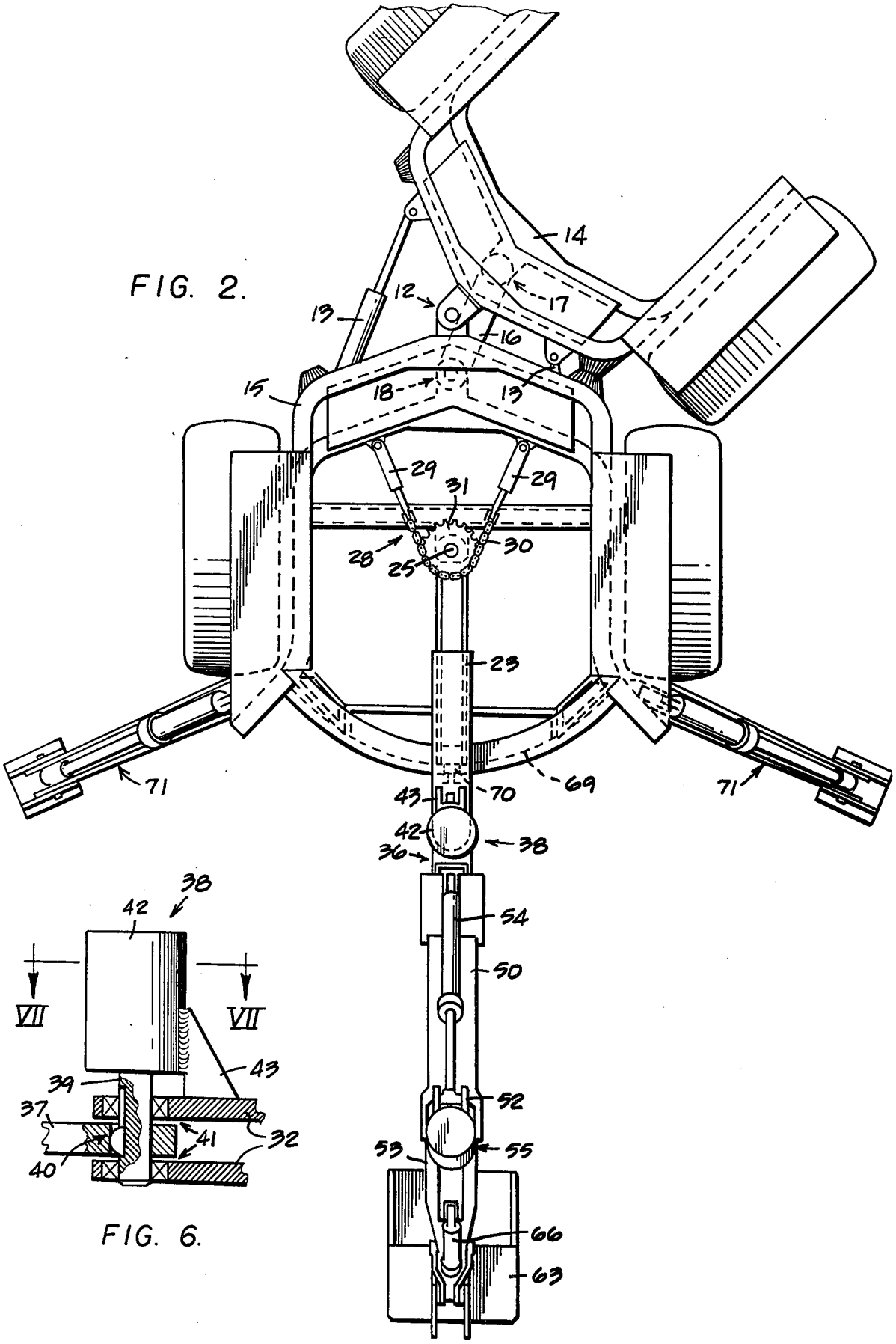
FIG. 2 is a top elevational view of the backhoe, but with an operator's station and attendant structures removed therefrom for clarification purposes.
Figure 4A:
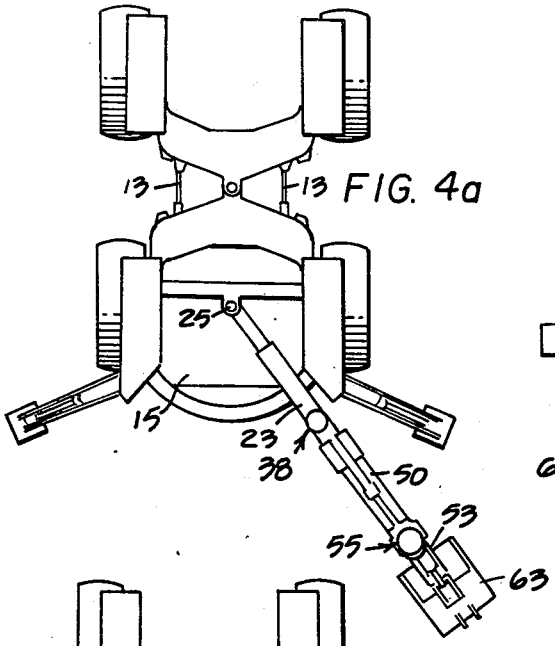
Figure 4B:
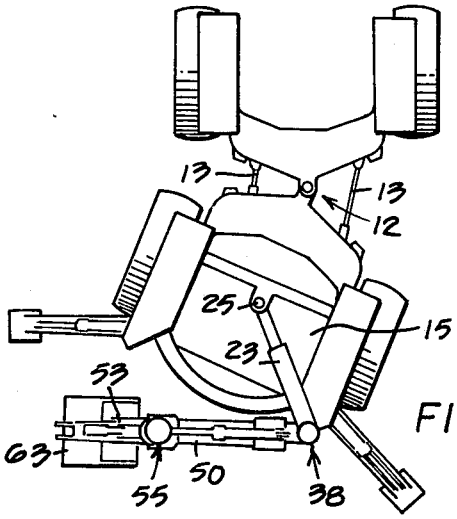
Figure 4C:
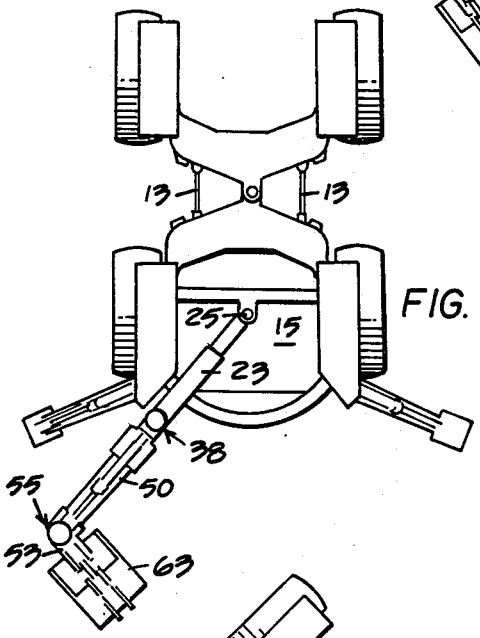
Figure 4D:
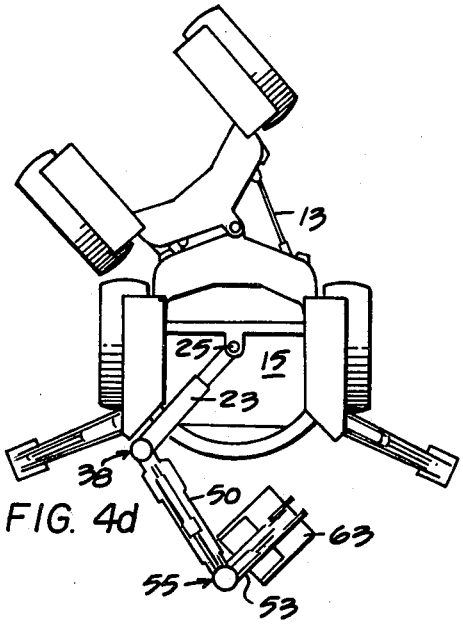
Figure 4E:
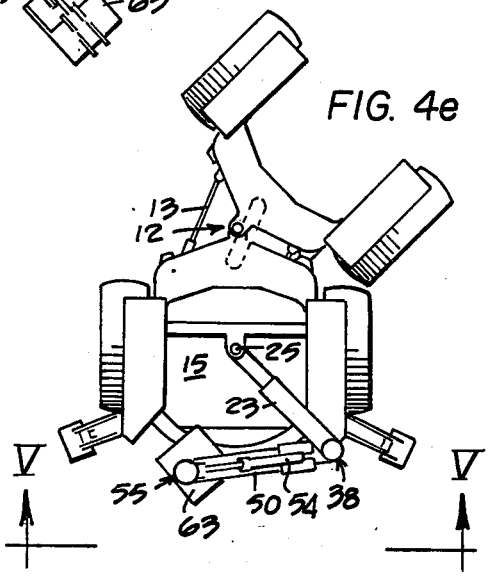
Figure 5:
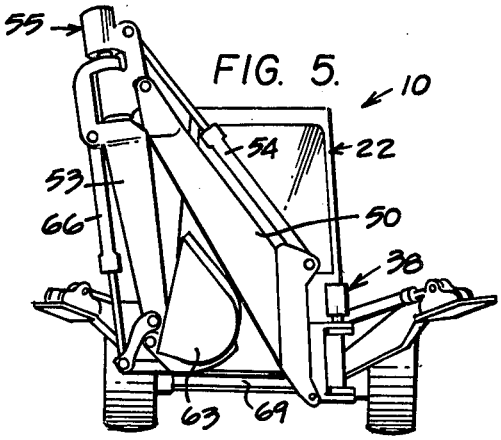

FIS. 4*a* through 4*e* are reduced top elevational views similar to FIG. 2, but illustrating the backhoe in various positions of operation;

FIG. 5 is a back elevational view of the backhoe, taken in the direction of arrows V—V in FIG. 4*e;*

Figure 7:
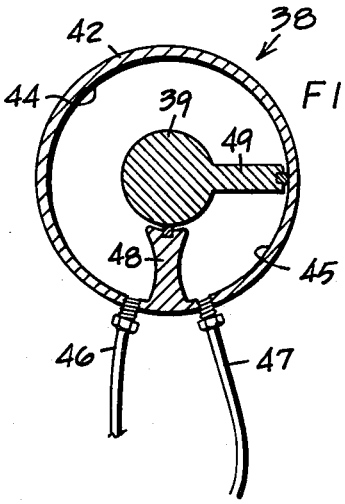
Figure 8:
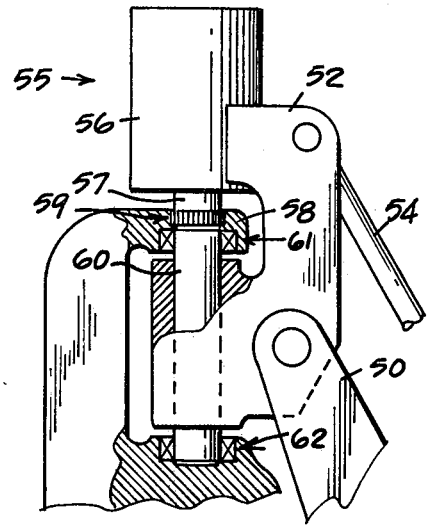
Figure 10:
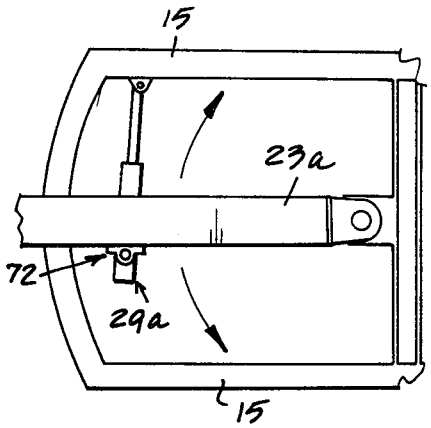
Figure 9:
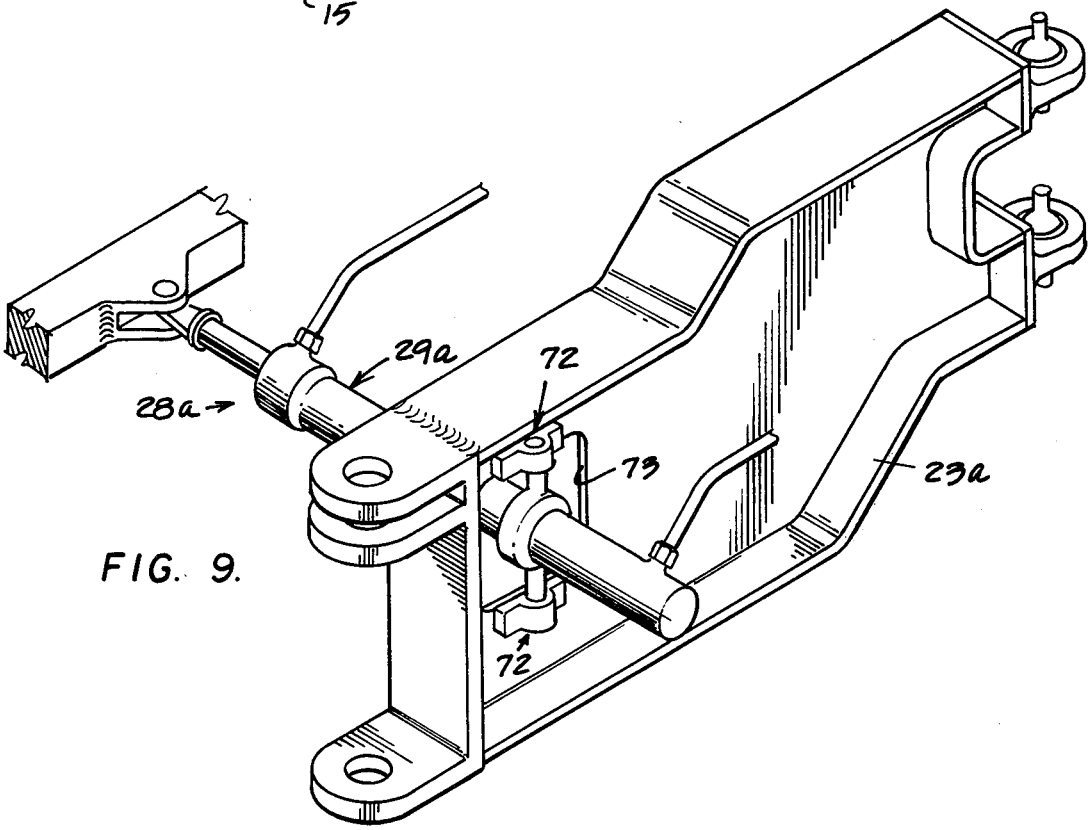
Figure 11:
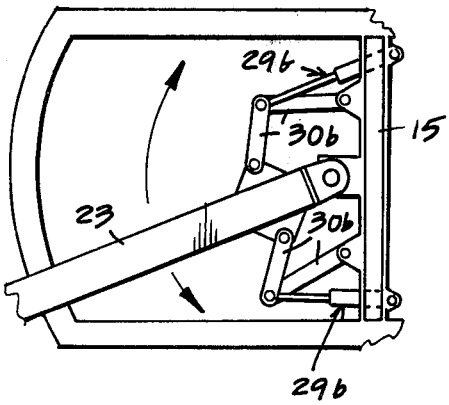
Figure 12:
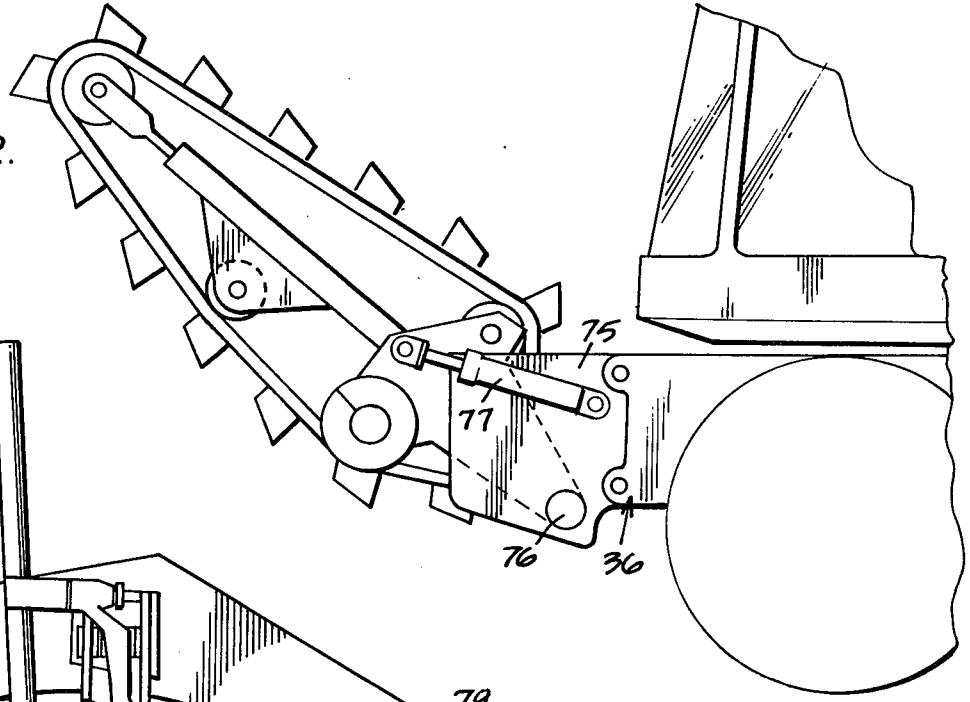
Figure 13:
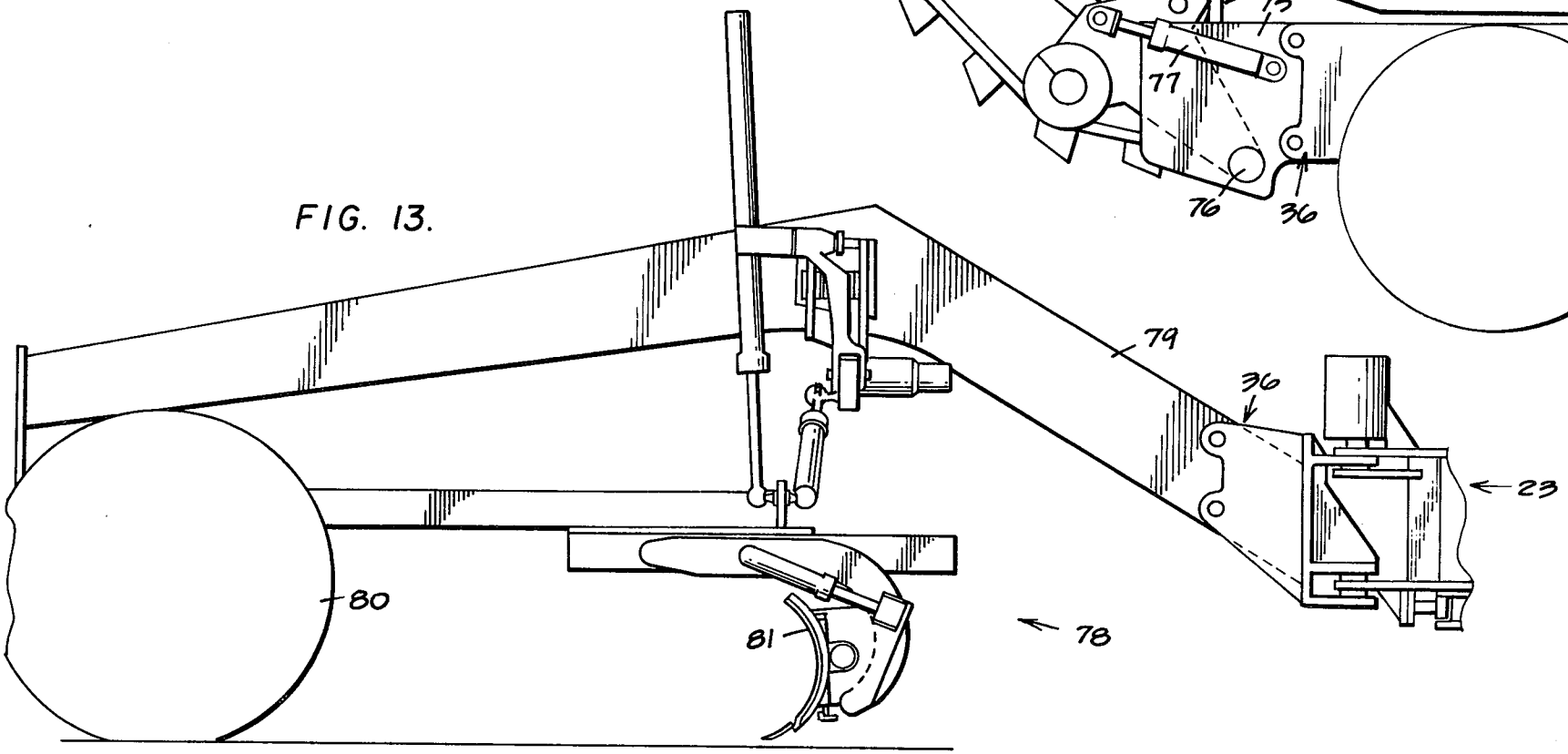

FIG. 6 is an enlarged and partially sectioned side elevational view of a first hydraulic swing motor and mounting therefor;

FIG. 7 is a cross sectional view of the swing motor, taken in the direction of arrows VII—VII in FIG. 6;

FIG. 8 is an enlarged and partially sectioned side elevational view of a second hydraulic swing motor and mounting therefor;

FIG. 9 is an isometric view of a modification of an actuating means employed in the backhoe;

FIG. 10 is a top plan view of the FIG. 9 actuating means;

FIG. 11 is a top plan view of a further modification of the actuating means;

FIG. 12 is a partial side elevational view of the backhoe, but with the backhoe assembly thereof having been replaced by a trencher assembly; and FIG. 13 is a partial side elevational view of the backhoe, but with the backhoe apparatus thereof having been replaced by a grader assembly.

DETAILED DESCRIPTION

Figure 1:
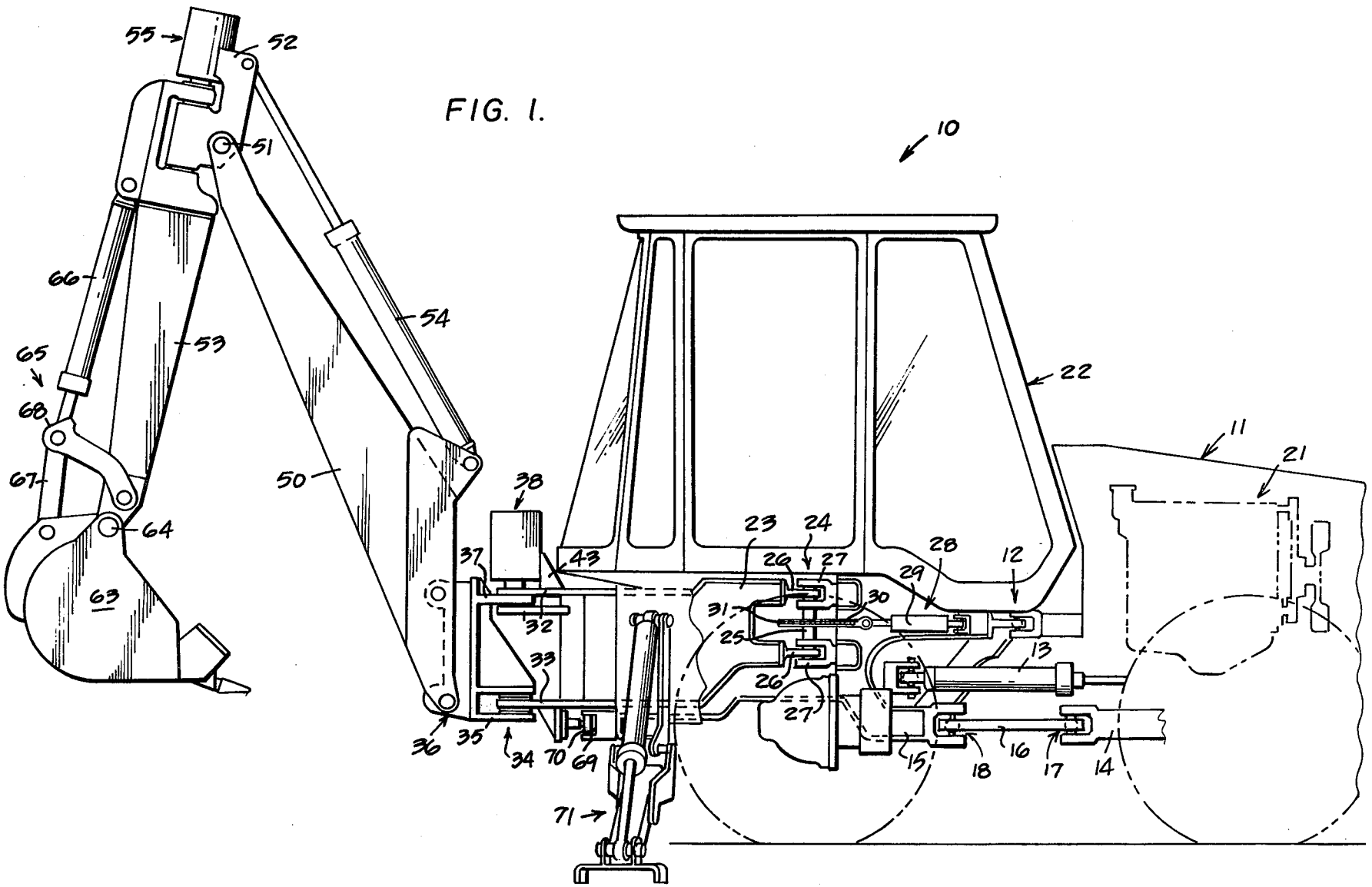
FIG. 1 is a side elevational view, partially schematic, illustrating a backhoe of this invention with portions broken-away to expose internal constructions thereof.
Figure 3:
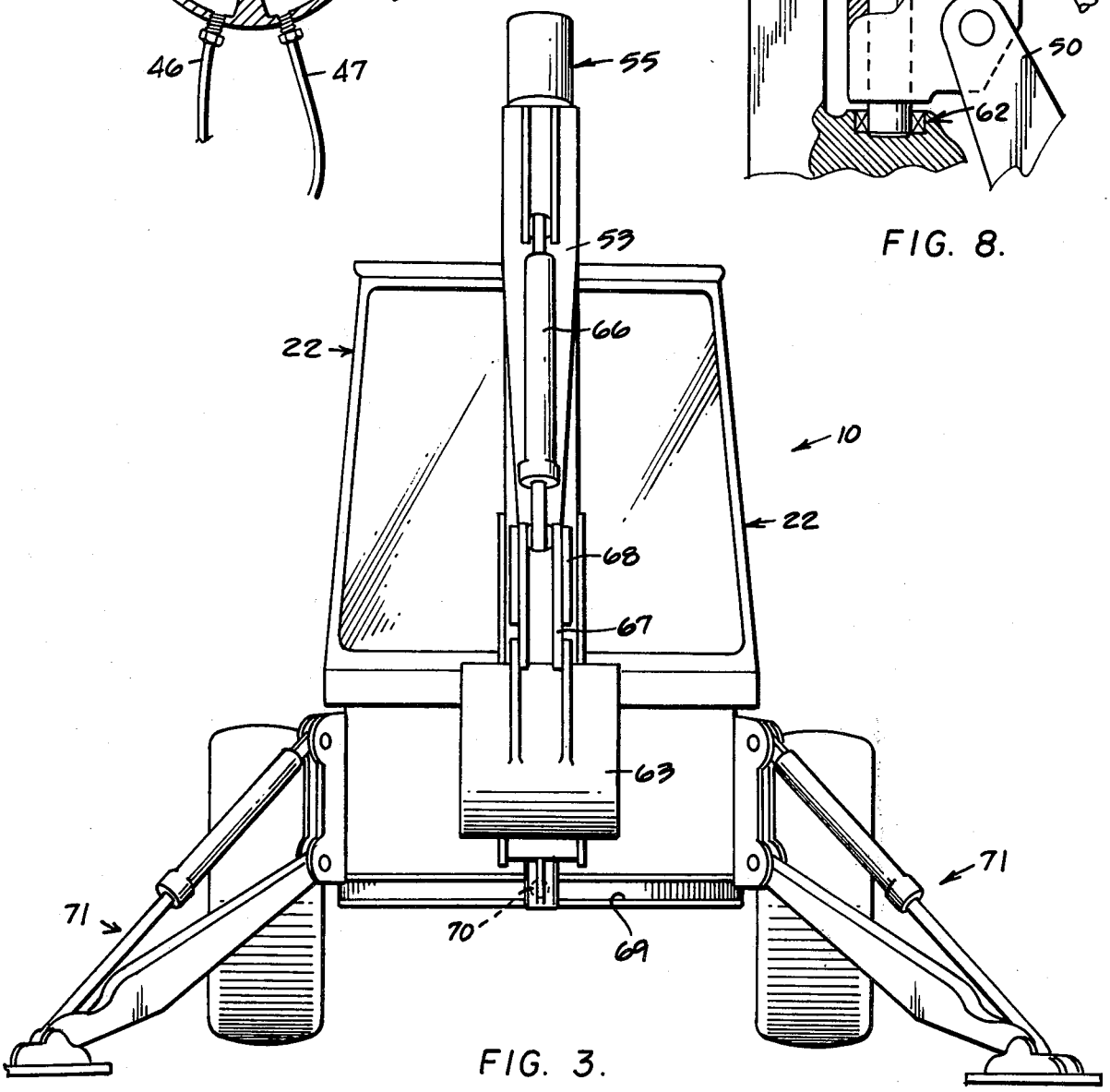
FIG. 3 is a back elevational view of the backhoe.

FIGS. 1–3 illustrate a construction vehicle in the form of a backhoe 10 comprising a tractor 11 mounted for movement on ground-engaging wheels. The frame of the tractor is articulated at a universal pivot means 12, preferably comprising a ball and socket connection. A pair of double-acting hydraulic cylinders 13 are pivotally interconnected by ball and socket connections between a front frame 14 and a rear frame 15 of the backhoe for steering purposes.

A single link 16 is disposed vertically below pivot means 12. The link is pivotally interconnected between the front and rear frames by universal pivot means comprising ball and socket connections 17 and 18, respectively. The above described connection means will thus allow slight relative vertical movements of frames 14 and 15 upon steering of the vehicle.

An engine, schematically illustrated at 21, is mounted on the front frame whereas an operator's cab 22 is suitably mounted on the rear frame. The rear frame has an elongated support member or beam 23 pivotally mounted thereon by the first pivot means 24 for permitting horizontal pivotal movements of the support member relative to rear frame 15. As shown in FIGS. 1 and 2, such pivot means is disposed at the approximate longitudinal center of the backhoe and comprises a vertically disposed pivot pin 25 secured to a pair of vertically spaced projections 26 of the support member.

A pair of vertically spaced clevises 27 are secured to rear frame 15 to rotatably mount the ends of shaft 25 therein by suitably arranged bearing means (not shown). A first actuating means 28 is operatively interconnected between the support member and rear frame for selectively pivoting the support member about pivot means 24. Such actuating means may comprise a pair of double-acting hydraulic cylinders 29 pivotally connected at their forward ends to the rear frame and having their rearward or rod ends connected to a chain 30. The chain is entrained about a sprocket 31, suitably secured to pivot pin 25, whereby alternate extension and retraction of the cylinders will rotate the sprocket and pin 25 to swing support member 23 about the vertical axis thereof.

The rearward end of the support member comprises a pair of vertically spaced upper and lower brackets 32 and 33, respectively. The lower bracket is pivotally mounted by a second pivot means 34 on a clevis 35, formed integrally on a bracket 36 of a boom assembly. Upper bracket 32 forms a clevis having a projection 37 of bracket 36 pivotally mounted therein.

Referring to FIG. 6, a second actuating means 38, preferably in the form of a conventional hydraulic swing motor, has a drive or output shaft 39 extending downwardly therefrom. The lower end of the shaft is attached to bracket 37 at a key and slot or other suitable connection 40. Standard annular bearings 41 are provided to rotatably mount the shaft in bracket 32.

The swing motor further comprises a housing 42, suitably secured to support member 23 by a bracket 43 or the like. Referring to FIG. 7, the housing defines closed and isolated chambers 44 and 45 therein adapted to be selectively supplied with a pressurized fluid via flexible lines 46 and 47, respectively, communicating with the chambers on either side of a stationary vane 48 secured to the housing. A movable vane 49 is secured to shaft 39 to selectively pivot bracket 36 on the rear frame upon alternate communication and exhaust of fluid via lines 46 and 47 in a conventional manner.

The boom assembly further comprises a boom 50, suitably attached to bracket 46 for horizontal swinging movements therewith. A dipper stick assembly is pivotally mounted on an upper end of the boom by third pivot means comprising a pivot pin 51. The dipper stick assembly comprises a support bracket 52 pivotally connected to the boom at pin 51 and a dipper stick 53 extending downardly therefrom.

A third actuating means, preferably in the form of a double-acting hydraulic cylinder 54, is pivotally interconnected between boom 50 and bracket 52 for selectively pivoting the dipper stick assembly vertically on the boom. A fourth actuating means 55, preferably in the form of a second hydraulic swinging motor, is operatively interconnected between bracket 52 and dipper stick 53 to selectively rotate the dipper stick relative to the bracket. Referring to FIG. 8, the swing motor comprises a housing 56 suitably secured to bracket 52 and a drive or output shaft 57 extending downwardly therefrom.

The lower end of the shaft is suitably attached to an upper arm 58 of a clevis, formed on the upper end of the dipper stick, by a spline connection 59, for example. A pivot pin 60 is suitably secured to bracket 52 and has its upper end rotatably mounted in a first annular bearing assembly 61, suitably mounted in arm 58. The lower end of the pivot pin is suitably mounted for rotation in a second annular bearing assembly 62, mounted on the lower arm of the clevis of the dipper stick. The construction, arrangement and function of the drive motor are the same as those shown and described in regard to swing motor 38 of FIG. 7.

The lower end of dipper stick 53 has a bucket 63 pivotally mounted thereon by a fourth pivot means comprising a pivot in 64. A fifth actuating means 65 for selectively pivoting the bucket on the dipper stick preferably comprises a double-acting cylinder 66 having its upper end pivotally attached to the dipper stick. The lower rod end of the cylinder is pivotally connected to pairs of conventional links 67 and 68, pivotally connected to the bucket and dipper stick, respectively. FIGS. 4*a*–4*e* illustrate the backhoe in various conditions of operation to thus illustrate the work capabilities thereof. In FIG. 4*a*, hydraulic cylinders 29 (FIG. 2) have been suitably actuated to rotate support member 23 towards the right side of the backhoe as viewed in this figure. It should be noted in FIGS. 1–3 that a horizontally disposed arcuate track 69 is preferably secured on rear frame 15 to engage a support roller 70 attached to support member 23. A combined support and guide means is thus provided for supporting and guiding the support member upon pivoting thereof relative to the frame.

FIG. 4*b* illustrates support member 23 in its same position relative to frame 15, but with hydraulic motor 38 actuated to pivot boom 50 towards the leftside of the backhoe. FIG. 4*c* illustrates a condition wherein the boom is moved to a left side of the machine by cylinders 28 (FIG. 2) and motor 55 is actuated to rotate dipper stick 53 counterclockwise on the boom.

FIG. 4*d* illustrates a progression from the FIG. 4c condition wherein motor 38 is also actuated to pivot the boom counterclockwise on support member 23 to move bucket 63 towards the right or opposite side of the backhoe. FIG. 4*e* illustrates a storage condition wherein cylinders 28 have been actuated to move support member 23 to the right side of the backhoe, motor 38 has been actuated to pivot boom 50 in close proximity to a backside of the backhoe and cylinders 54 and 66 have been extended to respectively pivot the dipper stick and bucket in close proximity to the boom. FIG. 5 more clearly shows the latter positioning of the bucket relative to the boom and also the raising of hydraulically actuated stabilizing means 71, pivotally mounted on either side of frame 15 and disposed longitudinally between pivot means 24 and the boom assembly.

FIGS. 9 and 10 illustrate a modification 28*a* of actuating means 28 (FIG. 2). In particular, a double-acting hydraulic cylinder 29*a* has its rod end pivotally connected to rear frame 15 and its housing pivotally mounted by trunnions 72 on a modified support member 23*a* having an enlarged opening 73 formed therethrough. Thus, selective extension or retraction of the cylinder will pivot the support member relative to frame 15.

FIG. 11 illustrates a further modification of actuating means 28 wherein a pair of double-acting hydraulic cylinders 29*b* function to selectively pivot support member 23 relative to frame 15. The head end of each cylinder is pivotally mounted on the frame whereas the rod end thereof is pivotally connected to first ends of a pair of links 30*b*. A first link has its second end pivotally mounted on the frame whereas the second end of the second link is pivotally mounted on the support member.

FIG. 12 partially illustrates a construction vehicle of the type described above, except that a trenching assembly has been substituted in lieu of the backhoe assembly (boom 50, dipper stick 53, bucket 63, etc.). The trenching assembly comprises a support 75 suitably attached to bracket 36 (FIG. 1) having the frame of the trencher assembly pivotally mounted thereon by a shaft 76. A double-acting hydraulic cylinder 77 is pivotally interconnected between the frame of the trenching apparatus and support 75 for selectively raising (FIG. 12) and lowering the same relative to ground level.

FIG. 13 partially illustrates a construction vehicle wherein a grader assembly 78 has been substituted in lieu of the above-described backhoe assembly. A support frame 79 of the scraper assembly is suitably attached to support member 23 and has a mold board 81 movably mounted thereon in a conventional manner and is supported on a pair of roadwheels 80 (one shown).

I claim:

1. A backhoe comprising a frame, a support member, first pivot means pivotally mounting said support member on said frame for horizontal pivotal movements relative thereto, first actuating means operatively interconnected between said support member and said frame for selectively pivoting said support member relative thereto, a boom assembly, second pivot means pivotally mounting a lower end of said boom assembly on said support member for horizontal pivotal movements relative thereto, second actuating means operatively interconnected between said boom assembly and said support member for selectively swinging said boom assembly relative thereto, a dipper stick assembly, including a support bracket and a dipper stick having a clevis, defining a pair of spaced arms, rotatably mounted on said support bracket, third pivot means pivotally mounting said support bracket on an upper end of said boom assembly for vertical pivotal movements relative thereto, third actuating means operatively interconnected between said support bracket and said boom assembly for selectively pivoting said dipper stick assembly relative thereto, fourth actuating means operatively interconnected between said dipper stick and said bracket for selectively rotating said dipper stick thereon, and a work tool mounted on a lower end of said dipper stick.

2. The backhoe of claim 1 wherein said work tool is pivotally mounted on a lower end of said dipper stick and further comprising fifth actuating means operatively interconnected between said work tool and said dipper stick for selectively pivoting said work tool thereon.

3. The backhoe of claim 2 wherein said work tool constitutes a bucket.

4. The backhoe of claim 1 wherein the pivot axis of said first pivot means is vertically disposed and located at least approximately at a longitudinal center of said backhoe.

5. The backhoe of claim 1 wherein said frame comprises a front frame and a rear frame articulated together for relative movement about a vertically disposed pivot axis.

6. A backhoe of claim 5 wherein said front and rear frames are articulated together by universal pivot means disposed centrally in a transverse direction to said backhoe and link means interconnected between said front and rear frames.

7. The backhoe of claim 6 wherein said link means is normally disposed in at least general vertical alignment with respect to said universal pivot means.

8. The backhoe of claim 7 wherein said link means constitutes a single link universally interconnected between said front and rear frames.

9. The backhoe of claim 5 further comprising a pair of laterally spaced double-acting hydraulic steering cylinders each pivotally interconnected between said front and rear frames for selectively pivoting said front frame relative to said rear frame.

10. The backhoe of claim 1 further comprising a pair of hydraulically actuated stabilizing means disposed longitudinally between said first pivot means and said boom assembly and each pivotally mounted on either side of said frame for selective movement between a raised stored position and a lowered ground-engaged stabilizing position.

11. The backhoe of claim 1 wherein said support member constitutes an elongated beam and combined support and guide means mounting a rearward end of said beam on said frame for supporting and guiding said beam upon pivoting thereof relative to said frame.

12. The backhoe of claim 11 wherein said support and guide means comprises a horizontally disposed arcuate track formed on a rearward end of said frame and at least one roller rotatably mounted on said beam and disposed for rolling movements in said track.

13. The backhoe of claim 1 wherein said first pivot means comprises a pivot pin pivotally interconnecting said frame and support member together.

14. The backhoe of claim 13 wherein said first pivot means further comprises a pair of vertically spaced projections formed on one of said frame and support member and a pair of clevises formed on the other one of said frame and support member to each receive a respective projection therein and wherein said pivot pin is secured to one of said pairs of projections and clevises and the other of said pair are rotatably mounted on said pivot pin.

15. The backhoe of claim 14 wherein said projections are formed on said support member and said clevises are formed on said frame.

16. The backhoe of claim 13 wherein said first actuating means comprises a sprocket secured to said pin, a chain entrained about said sprocket and a pair of double-acting hydraulic cylinders each having one end pivotally connected to said frame and the other end connected to a respective end of said chain whereby alternate extension and retraction of said cylinders will selectively rotate said sprocket, pin and said support member relative to said frame.

17. The backhoe of claim 1 wherein said first actuating means comprises a single double-acting hydraulic cylinder pivotally interconnected between said frame and said support member.

18. The backhoe of claim 1 wherein said first actuating means comprises a pair of double-acting hydraulic cylindes each having one end thereof pivotally mounted on said frame and the other end thereof pivotally connected to first ends of a pair of first and second links, the second end of said first link pivotally connected to said frame and the second end of said second link pivotally connected to said support member.

19. The backhoe of claim 1 wherein said second pivot means comprises a pair of vertically spaced projections formed on one of said support member and boom and a pair of clevises formed on the other one of said support member and boom to each pivotally mount a respective projection therein.

20. The backhoe of claim 19 wherein said second actuating means constitutes a hydraulic swing motor.

21. The backhoe of claim 19 wherein said motor comprises a housing secured to said support member and defining a working chamber therein and a drive shaft rotatably mounted in said housing and on one of said projections and a respective clevis and attached to the other one of said projections and respective clevis.

22. The backhoe of claim 21 wherein said drive shaft is attached to a said projection and said projection is formed on said boom.

23. The backhoe of claim 1 wherein said third pivot means comprises a pivot pin pivotally mounting said bracket on said boom.

24. The backhoe of claim 23 wherein a pivot pin is attached to said bracket and has opposite ends thereof each rotatably mounted in a respective one of said arms.

25. The backhoe of claim 1 wherein said fourth actuating means constitutes a hydraulic swing motor.

26. The backhoe of claim 25 wherein said motor comprises a housing secured to said bracket and defining a working chamber therein and a drive shaft rotatably mounted in said housing and attached to said dipper stick for selectively rotating the same relative to said bracket.

* * * * *